US008063563B2

(12) United States Patent
Kuromiya et al.

(10) Patent No.: US 8,063,563 B2
(45) Date of Patent: Nov. 22, 2011

(54) PLASMA DISPLAY PANEL AND METHOD FOR PRODUCING THE SAME

(75) Inventors: Michiru Kuromiya, Osaka (JP); Tomohiro Okumura, Osaka (JP); Motoi Hatanaka, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/780,073

(22) Filed: May 14, 2010

(65) Prior Publication Data

US 2010/0289400 A1 Nov. 18, 2010

(30) Foreign Application Priority Data

May 15, 2009 (JP) ..... P2009-118599

(51) Int. Cl.
*H01J 17/49* (2006.01)

(52) U.S. Cl. ..... 313/587

(58) Field of Classification Search ..... None
See application file for complete search history.

(56) References Cited

U.S. PATENT DOCUMENTS

| | | | | |
|---|---|---|---|---|
| 5,838,106 | A * | 11/1998 | Funada | 313/587 |
| 6,066,917 | A * | 5/2000 | Funada | 313/587 |
| 7,923,931 | B2 * | 4/2011 | Park et al. | 313/586 |
| 2001/0005115 | A1 | 6/2001 | Busio et al. | |
| 2005/0206318 | A1 * | 9/2005 | Hirota et al. | 313/585 |
| 2005/0264487 | A1 * | 12/2005 | Tokunaga et al. | 345/63 |
| 2009/0263648 | A1 * | 10/2009 | Saitoh et al. | 428/336 |

FOREIGN PATENT DOCUMENTS

| | | |
|---|---|---|
| JP | 2002-53342 | 2/2002 |
| JP | 2003-518318 | 6/2003 |
| WO | 01/46980 | 6/2001 |

* cited by examiner

*Primary Examiner* — Ashok Patel
(74) *Attorney, Agent, or Firm* — Wenderoth, Lind & Ponack, L.L.P.

(57) ABSTRACT

A plasma display panel includes a front panel having a dielectric layer. The dielectric layer of the front panel includes a first dielectric layer and a second dielectric layer disposed on the first dielectric layer. The gas permeability of the second dielectric layer is in the range of 0% to 1%. The second dielectric layer may be formed by heating the surface of the first dielectric layer to thermally metamorphose or transubstantiate the first dielectric layer to a limited depth from the surface the first dielectric layer.

11 Claims, 6 Drawing Sheets

*(a)*

*(b)*

$$Ra = \frac{1}{L}\int_0^L \left| f(x) \right| dx$$

PLASMA DISPLAY PANEL AND METHOD FOR PRODUCING THE SAME

FIELD OF THE INVENTION

The present invention relates to a method for producing a plasma display panel. In particular, the present invention relates to a method for producing a dielectric layer which is provided in a front panel of a plasma display panel. The present invention also relates to a plasma display panel obtained by such a method.

BACKGROUND OF THE INVENTION

A plasma display panel (hereinafter also referred to as "PDP") is suitable for displaying a high-quality television image on a large screen. Thus, there has been an increasing need for various kinds of display devices using the plasma display panel.

The PDP (for example, 3-electrode surface discharge type PDP) comprises a front panel facing the viewer and a rear panel opposed to each other. The front panel and the rear panel are sealed along their peripheries by a sealing material. Between the front panel and the rear panel, there is formed a discharge space filled with a discharge gas (helium, neon or the like).

The front panel is generally provided with a glass substrate, display electrodes (each of which comprises a scan electrode and a sustain electrode), a dielectric layer and a protective layer. Specifically, (i) on one of principal surfaces of the glass substrate, the display electrodes are formed in a form of stripes; (ii) the dielectric layer is formed on the principal surface of the glass substrate so as to cover the display electrodes; and (iii) the protective layer is formed on the dielectric layer so as to protect the dielectric layer.

The rear panel is generally provided with a glass substrate, address electrodes, a dielectric layer, partition walls and phosphor layers (i.e. red, green and blue fluorescent layers). Specifically, (i) on one of principal surfaces of the glass substrate, the address electrodes are formed in a form of stripes; (ii) the dielectric layer is formed on the principal surface of the glass substrate so as to cover the address electrodes; (iii) a plurality of partition walls are formed on the dielectric layer at equal intervals; and (iv) the phosphor layers are formed on the dielectric layer such that each of them is located between the adjacent partition walls.

In the PDP, the display electrode and the address electrode perpendicularly intersect with each other, and such intersection portion serves as a discharge cell. A plurality of discharge cells are arranged in the form of a matrix. Three discharge cells, which have red, green and blue phosphor layers in the arranged direction of the display electrodes, serve as picture elements for color display. In operation of the PDP, ultraviolet rays are generated in the discharge cell upon applying a voltage, and thereby the phosphor layers capable of emitting different visible lights are excited. As a result, the excited phosphor layers respectively emit lights in red, green and blue colors, which will lead to an achievement of a full-color display.

Recently, miniaturization of the discharge cells has been promoted by a demand for a higher definition of the PDP. For example, it is necessary to form the partition walls at 100 μm pitch on the rear panel in order to achieve the higher definition. However, a size reduction of the discharge cells leads to a decrease in emission brightness and thus an increase in power consumption. This is caused by a decrease in an opening ratio, a decrease in light emission time per picture element attributable to an increase in picture element number, a decrease in luminous efficiency or the like. As a method for increasing emission brightness, there has been proposed a method of increasing the opening ratio by decreasing the width of partition walls of the rear panel. However, even in this method, the emission brightness is still insufficient and a further improvement is required.

There has been proposed another method wherein a dielectric constant of a dielectric body in a front panel is decreased, and thereby reducing a reactive power upon discharge so as to improve the luminous efficiency. According to a formation of a front-sided dielectric layer in current method for producing PDPs, a dielectric material which contains glass powder with a size of several μms, an organic binder and a solvent is applied onto a glass plate by a known process such as screen printing process, die coating process or the like. Subsequently, a dielectric layer is formed from the glass material by a drying step, a debindering step (300 to 400° C.) and a calcining step (500 to 600° C.). However, as for current dielectric materials, the glass powder tends to be melted at a low temperature, and thus a "material capable of decreasing a melting point of the glass (e.g. Bi)" is added thereto (see, for example, Japanese Patent Kokai Publication No. 2002-053342). Such material capable of decreasing a melting point of the glass has low purity and has a high dielectric constant of 10 or more. Although the dielectric constant can be decreased by adding other substances (e.g. alkali metal), a highly conductive metal such as silver is used as a main component in an electrode of PDP, and thus a diffusion and colloidization of the silver are promoted due to ion migration, which leads to an yellowing phenomenon in the dielectric body. The yellowing phenomenon has a great adverse influence on the optical characteristics of PDP.

In order to increase emission brightness by decreasing the dielectric constant of the dielectric layer, it is necessary to develop a new low dielectric constant material to replace current types of glass paste, and also develop a method of forming a dielectric layer using such material. As a process for forming a dielectric layer made of high-purity oxide, there has been a process in which a solid oxide is deposited on a substrate by sputtering process under vacuum atmosphere (i.e. sputtering deposition process), and also there has been another process in which a material is deposited by decomposing a raw material with plasma (i.e. chemical vapor deposition process). Although these processes can produce a dielectric layer with a high purity and a low dielectric constant, expensive vacuum facilities are required and a film-forming rate is so low as about several 100 nm per minute. In this regard, for preventing a dielectric breakdown phenomenon upon application of voltage, the required thickness of the dielectric film is usually 10 μm or more and thus the larger number of the equipments are required to increase a productivity thereof.

Alternatively, it has been proposed to melt silica with high purity. However, the melting of such silica is not practical since a high temperature of 1000° C. or higher is required.

As a process for forming a dielectric layer with low dielectric constant while ensuring productivity, there has been proposed a sol-gel process. According to this process, a metal alkoxide is hydrolyzed in a solvent to give a silicon compound and subsequently the silicon compound is subject to a condensation polymerization treatment by heating thereof to form a film which mainly consists of silicon oxide. For example, in a case where the silicon compound is a silicon hydroxide ($Si(OH)_4$), a network of —Si—O—Si— is formed by the following condensation polymerization reaction and thereby a solid $SiO_2$ is formed to give a dielectric layer.

$$n\mathrm{Si(OH)_4} \rightarrow n\mathrm{SiO_2} + 2n\mathrm{H_2O}$$

(n: an integer of 1 or more)

In a case where the silicon compound is a siloxane, a dielectric layer is formed by the following condensation polymerization reaction.

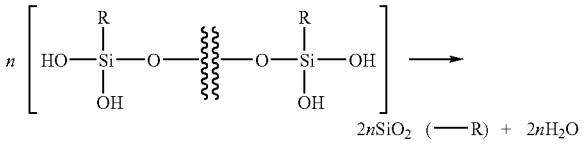

(R: alkyl group or hydrogen atom, n: interger of 1 or more)

According to the sol-gel process, a dielectric layer can be formed with a low production cost and a short takt time since the existing facilities are available for the application of the raw material paste. Furthermore, according to the sol-gel process, the dielectric layer can be formed at a lower temperature since no melting of the glass is required. However, a cracking phenomenon generally occurs in the dielectric layer as a result of a volume shrinkage thereof attributable to the condensation polymerization reaction (see FIGS. 7 and 8). For this reason, it is generally difficult to form a thick film of the dielectric layer (for example, it is generally difficult to form a dielectric layer with a thickness of about 100 nm).

There have been also proposed a method of preventing the cracks from occurring wherein polysiloxane material is modified from a fully inorganic material to a material with an alkyl group so that the alkyl group remains after condensation, thereby decreasing the difference in thermal expansion between the dielectric layer and the glass substrate/electrodes upon the heating of the dielectric material (see, for example, Japanese Patent Kokai Publication No. 2003-518318). In operation of the PDP, however, the residual alkyl group may be gasified and thus the gasified gas may deteriorate the phosphor layer of the rear panel, which will lead to a lower brightness of the PDP.

Under the above circumstances, the present invention has been created. Thus, an object of the present invention is to provide a method for producing a PDP in which a deterioration of the brightness is prevented when used the method being capable of effectively preventing or reducing a cracking phenomenon which may occur upon the formation of the dielectric layer.

SUMMARY OF THE INVENTION

In order to achieve the object as described above, the present invention provides a method for producing a plasma display panel comprising a front panel wherein an electrode, a dielectric layer and a protective layer are formed on a substrate of the front panel, a formation of the dielectric layer comprising:

(i) preparing a dielectric material comprising a glass component, an organic solvent and silica particles;

(ii) supplying the dielectric material onto the substrate having the electrode thereon, and then allowing the organic solvent contained in the supplied dielectric material to evaporate to form a dielectric precursor layer therefrom;

(iii) heating the dielectric precursor layer to form a first dielectric layer therefrom; and (iv) heating the surface of the first dielectric layer as a local heat treatment to form a second dielectric layer to a limited depth from the surface of the first dielectric layer.

According to the method of the present invention, there is formed a dielectric layer having a two-layered structure composed of a first dielectric layer and a second dielectric layer. The method of the present invention is characterized in that the second dielectric layer is formed by heating the surface of the first dielectric layer as a local heat treatment. In other words, the second dielectric layer is formed by heating the surface of the first dielectric layer to thermally metamorphose or transubstantiate the first dielectric layer to a limited depth from the surface thereof.

The phrase "local heat treatment" as used in this specification and claims substantially means the heating of a part of the first dielectric layer (particularly the heating of the first dielectric layer to a limited depth from the surface thereof), not the heating of the entire first dielectric layer. In a particularly preferred embodiment, the surface of the first dielectric layer is heated by subjecting the first dielectric layer to a rapid thermal heat treatment (e.g. rapid thermal annealing) in order to form the second dielectric layer. The second dielectric layer thus formed has a lower permeability to gas. In a temperature range of from the room temperature to 500° C. for example, a gas permeability of the second dielectric layer is preferably roughly in the range of from 0% to 1%. Since the second dielectric layer has a lower gas permeability, the gas that may be contained or generated in the dielectric layer can be prevented from being released to an internal space of the POP. In this regard, the second dielectric layer can also be referred as "cap layer" in light of its function and form.

As used in this specification and claims, the phrase "front panel" refers to a PDP panel disposed on the front side facing the viewer, and thus substantially means a PDP panel disposed on the side where the phosphor layer and partition walls are not provided. In other words, the front panel is a POP panel disposed to oppose a rear panel whereon the phosphor layer and the partition walls are provided.

In a preferred embodiment, the local heat treatment of the first electric layer is performed so that the second dielectric layer has a thickness of 30% or less of the total thickness of the dielectric layer (i.e. the total thickness of the front-sided dielectric layer). In other words, the surface of the first dielectric layer is heated to produce the second dielectric layer with its thickness of from 0 (excluding 0) to 30% of the total thickness of the dielectric layer of the front panel.

In another preferred embodiment, the glass component contained in the dielectric material has a siloxane bond (i.e. siloxane backbone) and an alkyl group. The mean particle size of the silica particles contained in the dielectric material is preferably in the range of from 50 to 200 nm.

In the step (iv) of the method of the present invention, it is preferred that the silica particles contained to the limited depth from the surface of the first dielectric layer is allowed to melt by subjecting the first dielectric layer to the local heat treatment. In other words, the silica particles contained in the vicinity of the surface of the first dielectric layer is melted by the local heat treatment of the first dielectric layer. For performing the local heat treatment of the step (iv), a heat source such as plasma torch, laser and flash lamp may be used.

The present invention also provides a plasma display panel obtained by the method described above. Such plasma display panel comprises a front panel and a rear panel opposed to each other, the front panel being a panel wherein an electrode, a dielectric layer and a protective layer are formed on a substrate, and the rear panel being a panel wherein an electrode, a dielectric layer, a partition wall and a phosphor layer on a substrate;

the dielectric layer of the front panel is composed of a first dielectric layer and a second dielectric layer wherein the first dielectric layer is in contact with the substrate of the front panel and the second dielectric layer is disposed on the first dielectric layer; and the second dielectric layer is made of a material obtained by a melting of silica particles and a subsequent solidifying of the melted particles. In one embodiment of the plasma display panel, the dielectric layer (particularly the first dielectric layer) comprises an alkyl group.

In a preferred embodiment, the thickness of the second dielectric layer is 30% or less of the dielectric layer of the front panel. In other words, the thickness of the second dielectric layer is in the range of from 0 (excluding 0) to 30% of the total thickness of the dielectric layer of the front panel. It is preferred in the plasma display panel of the present invention that the total thickness of the dielectric layer is from about 10 to 30 μm. It should be noted that the total thickness of the dielectric layer is equal to the thickness of the first dielectric layer plus the thickness of the second dielectric layer.

In a preferred embodiment, the surface roughness of the second dielectric layer is 5 nm or less in terms of arithmetic mean surface roughness Ra.

In accordance with the method of the present invention, the glass component comprises an alkyl group, and thus it is made possible to decrease the difference in thermal expansion between "dielectric layer" and "glass substrate/display electrodes" upon the heating of the dielectric material. As a result, the occurrence of the cracking phenomenon attributable to the difference in thermal expansion can be effectively prevented or reduced. In use of the PDP, the second dielectric layer can prevent the gas originating in the residual alkyl group from being released to an internal space of the PDP, which makes it possible to avoid such a trouble from occurring as the released gas is adsorbed to the phosphor layer of the rear panel, thus deteriorating the phosphor layer. As a result, there is realized a plasma display panel with a higher efficiency of light emission and a lesser deterioration of brightness.

In the PDP obtained by the producing method described above (namely the PDP of the present invention), the dielectric layer is substantially free of physical defects such as cracking. As a result of having no physical defects, the PDP has a high resistance to the dielectric breakdown phenomenon, and thereby a higher definition of the plasma display panels can be achieved. In other words, even when a high voltage is applied, the dielectric breakdown phenomenon in the dielectric layer does not occur, and thus the plasma display achieves higher definition.

According to the method of the present invention, a sol-gel process can be used for forming the dielectric, without the occurrence of cracking. Thus, the resulting dielectric layer can have a low dielectric constant of 5 or less. In other words, a low dielectric constant of the layer can be attained in view of the material, and thereby a high luminous efficiency is achieved, which will lead to a lower power consumption of PDPs.

DESCRIPTION OF REFERENCE NUMERALS

Figure 1:
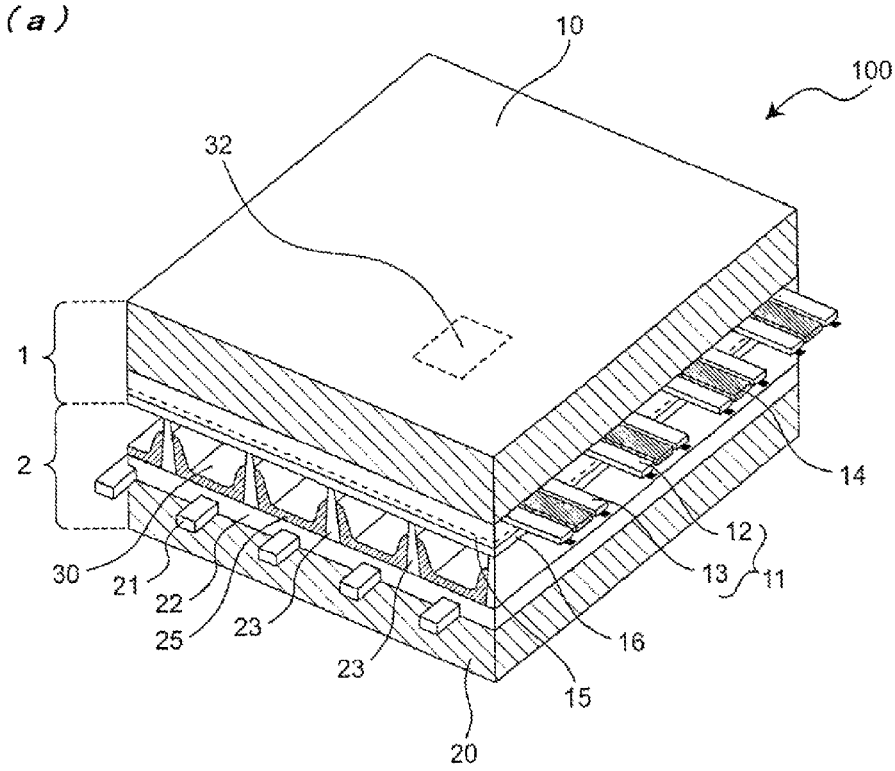
FIG. 1 shows a PDP wherein FIG. 1(*a*) is a perspective view schematically showing a structure of the PDP and FIG. 1(*b*) is a sectional view schematically showing a structure of the PDP front panel.
Figure 1:
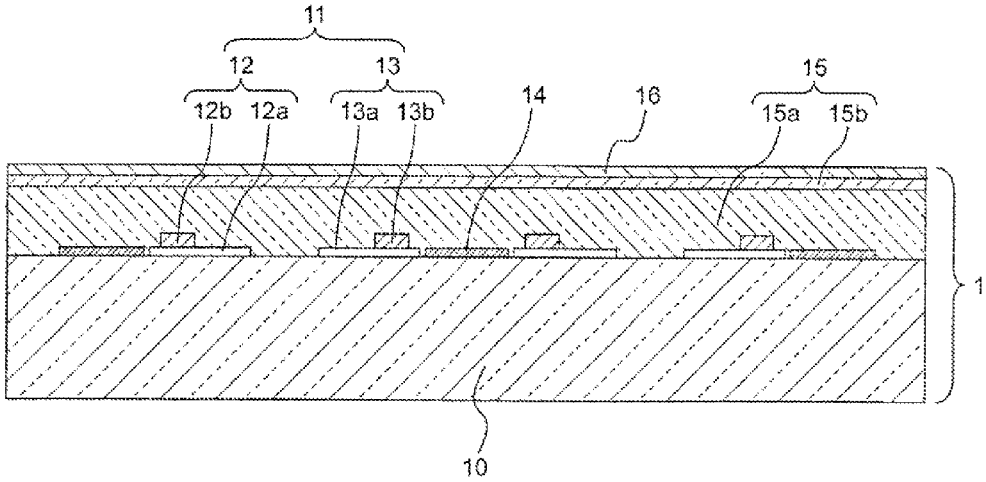

| | |
|---|---|
| 1 | Front panel |
| 2 | Rear panel (or Back panel) |
| 10 | Substrate of front panel |
| 11 | Electrode of front panel (Display electrode) |
| 12 | Scan electrode |
| 12a | Transparent electrode |
| 12b | Bus electrode |
| 13 | Sustain electrode |
| 13a | Transparent electrode |
| 13b | Bus electrode |
| 14 | Black stripe (light shielding layer) |
| 15 | Dielectric layer of front panel |
| 15' | Dielectric material |
| 15" | Dielectric precursor layer |
| 15a | First dielectric layer |
| 15b | Second dielectric layer |
| 16 | Protective layer |
| 20 | Substrate of rear panel |
| 21 | Electrode of rear panel (Address electrode) |
| 22 | Dielectric layer of rear panel |
| 23 | Partition wall (Barrier rib) |
| 25 | Phosphor layer (fluorescent layer) |
| 30 | Discharge space |
| 32 | Discharge cell |
| 50 | Cracking |
| 60 | Means for local heat treatment |
| 100 | PDP |

DETAILED DESCRIPTION OF THE INVENTION

The "method of producing a plasma display panel" and the "plasma display panel" according to the present invention will be described in detail below. Various components or elements are shown schematically in the drawings with dimensional proportions and appearances that are not necessarily real, which are merely for the purpose of making it easy to understand the present invention.

[Construction of Plasma Display Panel]

First, a plasma display panel, which can be finally obtained by the method of the present invention, is described below. FIG. 1(*a*) schematically shows a perspective and sectional view of the construction of PDP.

In a front panel (1) of PDP (100), a plurality of display electrodes (11) composed of a scan electrode (12) and a sustain electrode (13) are formed on a substrate (10). As the substrate (10), a smooth, transparent and insulating substrate (e.g. glass substrate) may be used. A dielectric layer (15) is formed over the substrate (10) so as to cover the display electrodes (11). A protective layer (16) (for example, protective layer made of MgO) is formed on the dielectric layer (15).

Particularly as for the display electrodes (11), each of the scan electrode (12) and the sustain electrode (13) is composed of a transparent electrode (12*a*, 13*a*) and a bus electrode (12*b*, 13*b*), as shown in FIG. 1(*b*). The transparent electrode (12*a*, 13*a*) may be an electrically conductive transparent film made of indium oxide (ITO) or tin oxide ($SnO_2$). It is preferred that the thickness of the transparent electrode is in the range of from about 50 nm to about 500 nm. While on the other hand, the bus electrode is a black electrode which mainly consists of silver. It is preferred that the thickness of the bus electrode is in the range of from about 1 μm to about 10 μm. The width of the bus electrode is preferably in the range of from about 10 μm to about 200 μm, and more preferably in the range of from about 50 μm to about 100 μm.

In a rear panel (2) arranged opposed to the front panel (1), a plurality of address electrodes (21) are formed on an insulating substrate (20). A dielectric layer (22) is formed over the substrate (20) so as to cover the address electrodes (21). A plurality of partition walls (23) are disposed on the dielectric layer (22) such that each walls (21) is located between the address electrodes (21). Phosphor layers (25) such as red, green and blue fluorescent layers are formed on a surface of the dielectric layer (22) such that each fluorescent layer is located between adjacent partition walls (23).

The front panel (1) and the rear panel (2) are opposed to each other while interposing the partition walls (23) such that the display electrode (11) and the address electrode (21) perpendicularly intersect with each other. Between the front panel and the rear panel, there is formed a discharged space filled with a discharge gas. As the discharged gas, a noble gas (e.g. helium, neon, argon or xenon) is used. With such a construction of the PDP (100), the discharge space (30) is divided by the partition walls (23). Each of the divided discharge space (30), at which the display electrode (11) and the address electrode (21) intersect with each other, serves as a discharge cell (32).

[General Method for Production of PDP]

Next, a typical production of the PDP (100) will be briefly described. The typical production of the PDP (100) comprises a step for forming the front panel (1) and a step for forming the rear panel (2).

As for the step for forming the front panel (1), the display electrode (11) is firstly formed on the glass substrate (10). Specifically, a transparent electrode is formed on the glass substrate (10) by a sputtering process, and subsequently a bus electrode is formed on the transparent electrode by a calcining process. Next, a dielectric material is applied over the glass substrate (10) so as to cover the display electrode (11), followed by a heat treatment thereof to form the dielectric layer (15). Next, the protective layer (16) is formed on the dielectric layer (15). Namely, a film made of MgO is provided by an electron-beam evaporation process (i.e. EB evaporation process).

As for the step for forming the rear panel (2), the address electrode (21) is firstly formed on the glass substrate (20) by a calcining process. Next, a dielectric material is applied over the glass substrate (20) so as to cover the address electrode (20), followed by a heat treatment thereof to form the dielectric layer (22). Subsequently, the partition walls (23) made of a low-melting point glass are formed in a form of predetermined pattern. Then a phosphor material is applied between the adjacent partition walls (23) and then calcined to form the phosphor layer (25). Next, a low-melting point frit glass material (namely, "sealing material to be used for panel sealing") is applied onto a periphery of the substrate (20) and then calcined to form a sealing component (not shown in FIG. 1(*a*)).

After the front and rear panels are obtained, so-called panel sealing step is performed. Specifically, the front panel (1) and rear panel (2) are disposed opposed to each other and then heated in their fixed state to soften the sealing component therebetween. Such sealing step enables the front panel and the rear panel to be air-tight bonded with each other by the sealing component. After the sealing step, the discharge space (30) is vacuumed while heating thereof, followed by a filling of the discharge space (30) with the discharge gas. In this way, PDP (100) is finally obtained.

[Method of the Present Invention]

The method of the present invention particularly relates to a production of a front panel (more particularly a dielectric layer of the front panel) in the PDP production. According to the method of the present invention, a local heat treatment is applied to the surface of the first dielectric layer, so as to form the second dielectric layer from a part of the first dielectric layer. This local heat treatment can produce a two-layered structure of the dielectric layer. Specifically, subsequent to the heat treatment of the entire dielectric precursor layer, a surface of the resulting dielectric layer is subjected to another heat treatment, and thereby the resulting dielectric layer is locally heated to a limited depth from the surface thereof.

Figure 2:
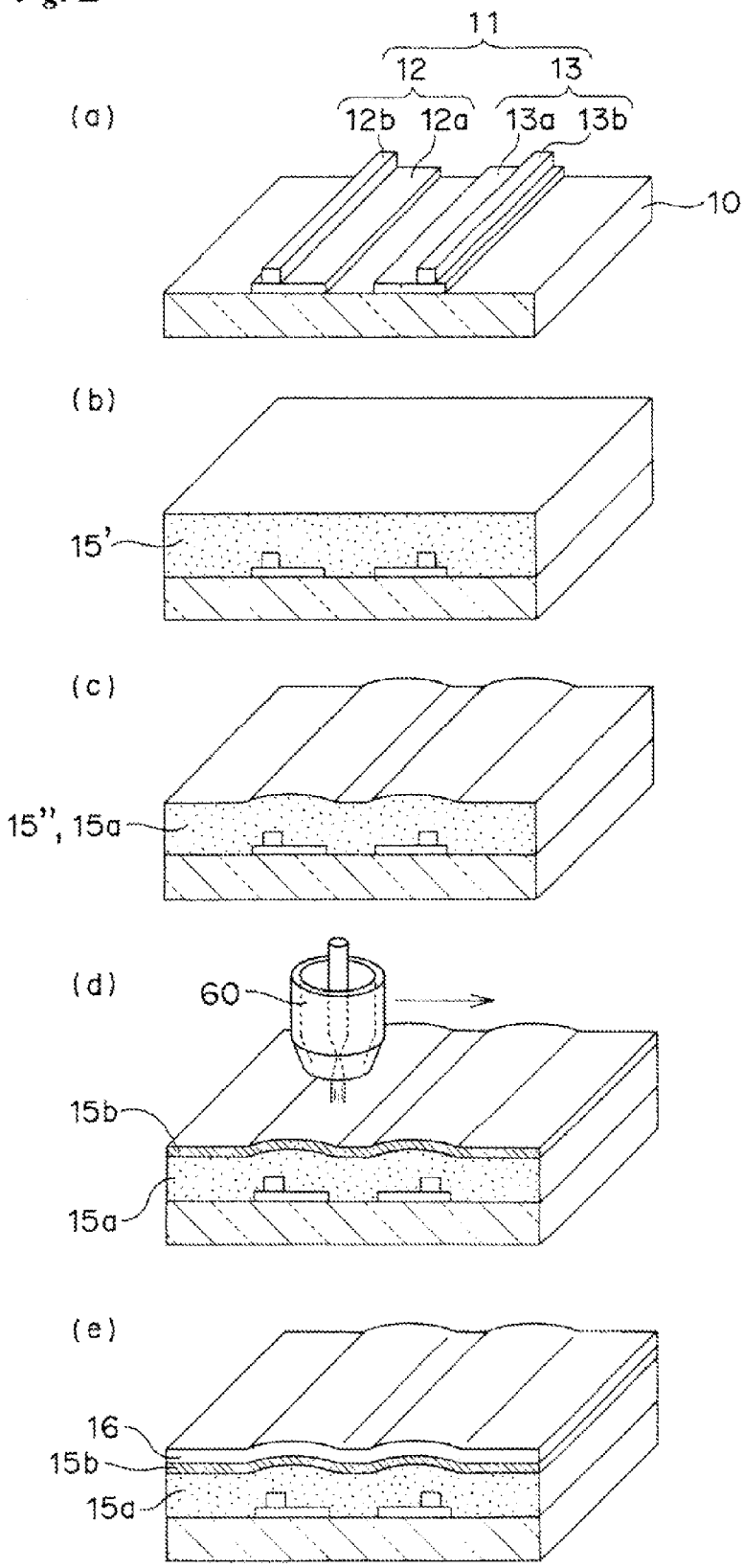
FIG. 2 is a perspective view schematically showing the steps in a method of the present invention.

With reference to FIG. 2, some embodiments of the present invention will be described below. The present invention is carried out firstly by preparing a substrate and a dielectric material. Specifically, the substrate (10) having the electrodes (11) formed thereon as shown in FIG. 2(*a*) is prepared, and also the dielectric material is prepared as a step (i).

As used in this specification, the phrase "the substrate having the electrodes formed thereon" means the substrate having the front-sided electrodes formed thereon. For example, "the substrate having the electrodes formed thereon" is a glass substrate with a display electrode thereon. Namely, there is prepared a glass substrate (10) on which a display electrode (11) composed of a scan electrode (12) and a sustain electrode (13) is formed. The substrate (10) itself is preferably an insulating substrate made of soda-lime glass, high-strain point glass or various kinds of ceramics. It is preferred that the thickness of the substrate (10) is in the range of from about 1.0 mm to 3 mm. As each of the scan electrode (12) and the sustain electrode (13) of the display electrode (11), a transparent electrode made of ITO (about 50 nm to about 500 nm in thickness) (12*a*, 13*a*) is provided, and also a bus electrode made of silver (about 1 μm to about 10 μm in thickness) (12*b*, 13*b*) is provided on the transparent electrode to decrease the resistance value of the display electrode (see FIG. 1(*b*)). Specifically, the transparent electrode is formed by a thin film process, and subsequently the bus electrode is formed by a calcining process. Particularly upon the formation of the bus electrode, first, a conductive paste containing silver as a main component is supplied in a form of stripes by a screen printing process so as to form a bus electrode precursor. Alternatively, the bus electrode precursor may be formed in a form of stripes by patterning it using photolithography wherein a photosensitive paste which mainly contains silver is applied by a die coating process or a printing process, and then dried at 100° C. to 200° C., followed by exposure and developing thereof. Moreover, the bus electrode precursor may be formed by a dispensing process or an ink-jet process. The resulting bus electrode precursor is dried and then finally calcined at 400° C. to 600° C. to form a bus electrode therefrom.

As the dielectric material of the step (i), a paste material is prepared. The paste material mainly consists of a glass component, an organic solvent and silica particles. Such paste is hereinafter also referred to as "dielectric material paste".

The glass component is preferably a pasty or sol-like fluid material obtained from an organic solvent and a precursor material upon carrying out the sol-gel process. More preferably, the glass component comprises polysiloxane with a siloxane backbone (—Si—O—) and an alkyl group. The siloxane backbone may be a linear, cyclic or three-dimensional network siloxane backbone. The alkyl group preferably has about 1 to 6 carbon atoms. Examples of the alkyl group include a methyl group, an ethyl group, a propyl group, a butyl group, a pentyl group and an hexyl group. The siloxane backbone may contain one or more kinds of these alkyl groups. Instead of the alkyl group, a functional group similar to the alkyl group such as an alkylene group (e.g. methylene group, ethylene group, propylene group or butylene group) may also be contained in the glass component.

For example, the glass component can be prepared by mixing a precursor material such as silicon alkoxide with an organic solvent and adding water or a catalyst thereto. More specifically, the glass component can be prepared by mixing a silicon alkoxide (particularly preferably a silicon alkoxide with an alkyl group) with an organic solvent and equally adding a small amount of water and a catalyst under a normal or elevated temperature while stirring them to proceed a hydrolysis or condensation polymerization thereof.

The above precursor material of the glass component is not particularly limited. Such precursor material may be a completely organic precursor material with no alkyl group, such as methyl silicate and ethyl silicate. More preferably, a precursor material of the glass component may be methyltrimethoxysilane, methyltriethoxysilane, methyltriisopropoxysilane, ethyltrimethoxysilane, ethyltriethoxysilane, ethyltriisopropoxysilane, octyltrimethoxysilane, octyltriethoxysilane, vinyltrimethoxysilane, vinyltriethoxysilane, phenyltrimethoxysilane, phenyltriethoxysilane, trimethoxysilane, triethoxysilane, triisopropoxysilane, fluorotrimethoxysilane, fluorotriethoxysilane, dimethyldimethoxysilane, dimethyldiethoxysilane, diethyldimethoxysilane, diethyldiethoxysilane, dimethoxysilane, diethoxysilane, difluorodimethoxysilane, difluorodiethoxysilane, trifluoromethyltrimethoxysilane, trifluoromethyltriethoxysilane, or the other alkoxide-based organic silicon compound ($Si(OR)_4$) having an alkyl group or a functional group similar to the alkyl group, such as tetratertiary butoxysilane (t-$Si(OC_4H_9)_4$), tetrasecondary butoxysilane sec-$Si(OC_4H_9)_4$ or tetratertiary amyloxysilane $Si[OC(CH_3)_2C_2H_5]_4$. These precursor materials can be used alone, but it is possible to suitably combine the above precursor materials with each other.

There is no particular limitation on the organic solvent. Examples of the organic solvent of the dielectric material include, but are limited to, alcohols such as methanol, ethanol, 1-propanol, 2-propanol, hexanol and cyclohexanol; glycols such as ethylene glycol and propylene glycol; ketones such as methyl ethyl ketone, diethyl ketone and methyl isobutyl ketone; terpenes such as α-terpineol, β-terpineol and γ-terpineol; ethylene glycol monoalkyl ethers; ethylene glycol dialkyl ethers; diethylene glycol monoalkyl ethers; diethylene glycol dialkyl ethers; ethylene glycol monoalkyl ether acetates; ethylene glycol dialkyl ether acetates; diethylene glycol monoalkyl ether acetates; diethylene glycol dialkyl ether acetates; propyleneglycol monoalkyl ethers; propylene glycol dialkyl ethers; propylene glycol monoalkyl ether acetates; propylene glycol dialkyl ether acetates; and monoalkyl cellosolves. These organic solvents can be used alone, but it is possible to suitably combine the above organic solvents with each other. Since it is desired that an organic solvent is vaporized by the heat treatment performed in the step (ii) of present invention, an organic solvent with a boiling point of about 300° C. or lower is preferably used, and an organic solvent with a boiling point of about 200° C. or lower is more preferably used.

The dielectric material paste contains silica particles (i.e. solid glass component) for the purpose of using it as a constituent element of the second dielectric layer and also for more effectively preventing cracking of the dielectric layer. Mean particle size of the silica particles is preferably in the range of from 50 to 200 nm. The particle sizes of 50 nm or larger makes it possible to more effectively prevent cracking from occurring. The reason for this is that it can mitigate the stress of the dielectric layer since there is provided a increased gap between the grains in the first dielectric layer, and also it can decrease specific surface area of the particles allowing uniform and sufficient amount of polysiloxane to cover the particles on the surface thereof. While on the other hand, the particle sizes of 200 nm or smaller makes it possible to increase permeability to visible light with wavelength of from 400 to 800 nm, which lead to an achievement of a desired optical characteristic. The silica particles may not necessarily be of a single size, and thus may have two or more sizes. When the silica particles have two or more particle sizes, a packing density of the silica particles can be increased in the dielectric layer, and thus an occurrence of the cracking can be more effectively prevented. As used in this description and claims, the phrase "particle size" substantially means the maximum dimension selected among dimensions of the particle in various directions. The phrase "mean particle size" substantially means a particle size calculated as a number average by measuring each size of 10 particles for example, based on an electron micrograph of the particles.

Any suitable silica particles such as crystalline silica particles and amorphous silica particles may be used. The silica particles may be used as a dry powder. Alternatively, the silica particles may also be used as being dispersed in water or organic solvent to form a sol state thereof. There is not limited to the surface condition and on the porosity of the silica particles. Thus, the silica particles that are commercially available may be used. The silica particles may be added either before or after preparing a sol-like dielectric material.

The amount of silica particles to be contained in the dielectric material is preferably determined in accordance to the ratio to the amount of siloxane backbone that remains in the dielectric layer. For example, the amount of silica particles to be contained in the dielectric material may be roughly in the range of from 10 to 99% by weight, and preferably roughly in the range of from 50 to 90% by weight with respect to the total weight of the dielectric layer to be finally formed.

The dielectric material (preferably dielectric material paste) used in the method of the present invention may optionally comprise a binder resin in order to improve the property of the dielectric material paste to make it easier to apply. Examples of the binder resin include polyethylene glycol, polyvinyl alcohol, polyvinyl butyral, methacrylate ester polymer, acrylate ester polymer, acrylate ester-methacrylate ester copolymer, α-methylstyrene polymer, butyl methacrylate resin and cellulose-based resin. These binder resins can be used alone, but it is possible to suitably combine the above binder resins with each other. While the dielectric material paste undergoes weight loss due to evaporation of the organic solvent at a high temperature (e.g. temperature of from about 200° C. to about 400° C.) the rate of decreasing weight of the paste as a whole can be suppressed, and thus a stress attributable thereto can be suppressed by using the binder resin. In addition, the binder resin can serve to assist a bonding between the silica particles at higher temperatures.

The dielectric material consisting of the above components is preferably used in the form of a paste. It is thus preferred that the viscosity of the dielectric material is in the range of from about 1 mPa·s to about 50 Pa·s at the room temperature (i.e. 25° C.) and a shear rate of 1000 [1/s]. When the viscosity of the dielectric material is within the above range, the undesirable spreading of the dielectric material can be effectively prevented upon an application thereof.

The contents of the components contained in the dielectric material are not particularly limited as long as it is usual contents used to obtain a typical dielectric layer of PDP (more specifically, as long as it is usual contents used to form a dielectric layer by a sol-gel process). Just as an example, however, the concentration of solid components in the dielectric material is preferably in the range of from 5% to 60% by weight, and more preferably in the range of from 15% to 35% by weight in light of the effects of the present invention. The concentration of solid components in this specification means the weight proportion of the glass component with respect to the total weight of the dielectric material, or the weight proportion of the glass component and the binder resin with respect to the total weight of the dielectric material. Larger thickness of the dielectric layer requires a larger thickness thereof in wet state. In this regard, the concentration of solid components of less than 5% by weight requires it to use a larger quantity of the paste, thus resulting in a higher materials cost. The concentration of solid components of more than 60% by weight, on the other hand, is not desirable because it brings the glass components (for example, grains of polyalkylsiloxane oligomer) too close so that the aggregation thereof tends to occur.

Subsequent to the step (i) the step (ii) is performed. Specifically, the dielectric material is supplied onto the substrate whereon the electrodes have been formed as shown in FIG. 2(*b*).

It is preferred that a slit coater process is employed to apply the dielectric material. The slit coater process is a process of applying a paste material to a desired surface by discharging a paste material under pressure from a wide nozzle. The dielectric material can also be applied by a dispensing process. In the dispensing process, a dielectric material paste is charged into a cylindrical vessel equipped with a small-diameter nozzle, and then the dielectric material paste is discharged therefrom by applying an air pressure to an aperture portion opposed to the nozzle. Alternatively, a spraying process, printing process and photolithography process may also be employed.

From the dielectric material that has been applied, the organic solvent contained therein is diminished by allowing it to evaporate (see FIG. 2(*c*)). As a result, a dielectric precursor layer (15") is formed. In other words, the dielectric precursor layer (15") is formed by diminishing the amount of the organic solvent from the applied dielectric material layer (15'). To diminish the organic solvent, the organic solvent must be evaporated from the applied dielectric material. For this purpose, the applied dielectric material may be either dried or placed under a reduced pressure or under a vacuum atmosphere. In a case where a drying process is employed for gasifying the organic solvent, it is preferable to place the applied dielectric material at a drying temperature of about 50 to 200° C. under an atmospheric pressure for 0.1 to 2 hours. When the reduced pressure or vacuum atmosphere is employed, the organic solvent is gasified by keeping the pressure below the saturated vapor pressure of the organic solvent under the atmosphere of the reduced pressure or vacuum. For example, it is preferable to place the applied dielectric material under a reduced pressure or vacuum atmosphere of 7 to 0.1 Pa. As required, "reduced pressure or vacuum atmosphere" and "heat treatment" may be combined.

The thickness of the dielectric precursor layer formed in step (ii) is preferably in the range of from about 10 to 30 μm. In this case, the thickness of the first dielectric layer obtained by the heat treatment of the step (iii) may also fall in the range of roughly from 10 to 30 μm. Setting the thickness to 10 μm or more makes it possible to not only prevent a dielectric breakdown phenomenon but also suppress such a trouble from occurring as the electrodes are heated upon the local heat treatment due to variation in height attributable to so-called "edge curl" of the electrode. While on the other hand, setting the thickness to 30 μm or less makes it possible to decrease the power loss during electric discharge caused by a decrease in dielectric constant of the dielectric layer.

Figure 3:
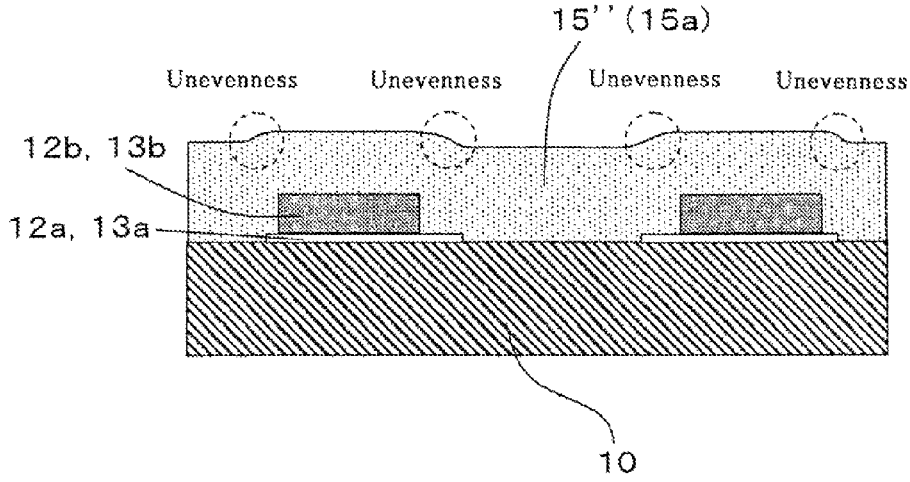
FIG. 3 is a schematic diagram showing "surface unevenness" (or "step") that may occur in a dielectric precursor layer or a dielectric layer.
Figure 3:
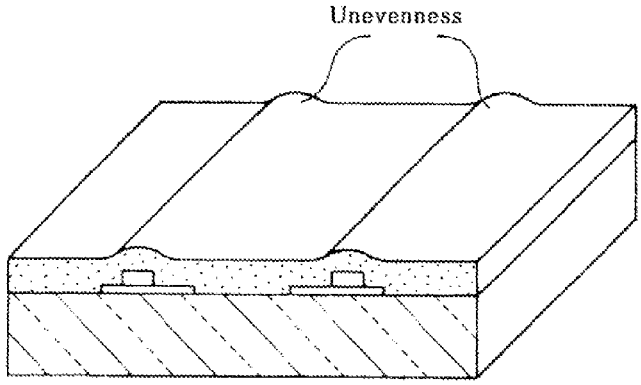

It is preferred that the size of "surface unevenness" of the dielectric precursor layer, which is formed due to the electrode thickness, is 5 μm or less and more preferably 0 μm. Such size of the surface unevenness of the dielectric precursor layer can contribute to more effective suppression of the cracking. To this end, it is preferable to increase the viscosity of the dielectric material paste or increase the concentration of solid component contained therein, thereby to suppress the paste from leveling after being applied. It is also effective to decrease the evaporation rate of the solvent so as to increase the boiling point of the solvent contained in the dielectric material paste and optimize the conditions of the drying and calcining processes, thereby suppressing the solid component in the paste material from moving upon a convection caused by drying. The phrase "surface unevenness" used herein refers to the surface irregularities of the dielectric precursor layer (or the surface irregularities of the dielectric layer) as shown in FIG. 3. Such surface unevenness is attributed mainly to the fact that there exists "electrode region" and "no-electrode region" in the surface of the substrate.

Subsequent to the step (ii), the step (iii) is performed. Namely, the dielectric precursor layer is heated to form the first dielectric layer from the dielectric precursor layer. In the step (iii), a condensation polymerization reaction proceeds in the dielectric precursor layer as the dielectric precursor layer is heated. Such condensation polymerization reaction eventually produces the first dielectric layer. In a case where the dielectric precursor layer contains the binder resin, the binder resin is burned so that it is removed from the dielectric precursor layer. The heating temperature of the step (iii) is determined by the calorific value required for the condensation polymerization reaction and other factors such as the boiling point and content of the organic solvent that may still remain in the precursor layer. The heating temperature of the dielectric precursor layer is typically in the range of from about 450° C. to about 550° C. Similarly, the period of time during of which the dielectric precursor layer is subjected to the heat treatment is also determined by comprehensively considering the calorific value required for the condensation polymerization reaction and other factors such as the boiling point and content of the organic solvent that may still remain in the precursor layer. Such heating time of the dielectric precursor layer, which depends on the kind of the dielectric material, is typically in the range of from about 0.5 hour to about 2 hour. As a heat treatment means, a heating chamber (e.g. calcining furnace) may be used, for example. In this case, the dielectric precursor layer can be entirely heated by placing "substrate with the display electrode and the dielectric precursor layer formed thereon" obtained from the step (ii) within the heating chamber.

Subsequent to the step (iii), the step (iv) is performed. Namely, a local heat treatment is applied to the first dielectric layer (15*a*) so as to form the second dielectric layer (15*b*) only into a limited depth from the surface of the first dielectric layer as shown in FIG. 2(*d*). Preferably, the local heat treatment enables the melting of the silica particles that are contained in the vicinity of the surface of the first dielectric layer, and thereby the second dielectric layer is formed through a solidification of the melted particles. The second dielectric layer thus obtained has a low permeability to a gas. For example, the second dielectric layer preferably has a gas permeability of from 0 to 1% at a temperature of from the room temperature to 500° C. The "permeability" as used herein means the proportion (in percentage) of the gas passing through the second dielectric layer at a temperature from room temperature to 500° C., such gas being supplied from the outside of the second dielectric layer. In this regard, the value of the permeability is measured, for example, by means of a mass fragmentography. Since the second dielectric layer has the low gas permeability, the gas that may exist in the dielectric layer or may be generated therefrom (for example, the gas that may be confined in pores of the dielectric layer) can be prevented from being released into internal space (e.g. discharge space 30) of the PDP. As a result, such a trouble is suppressed from occurring as the released gas is adsorbed onto the phosphor layer of the rear panel so that the phosphor layer is deteriorated.

Now consider a case where the second dielectric layer is formed by using a glass material with low melting point, not by melting and solidifying the silica particles. In this case, there is formed a dielectric layer having two-layered structure wherein a lower dielectric layer formed by sol-gel process using polysiloxane with a siloxane bond and an alkyl group, and an upper dielectric layer formed by using glass material with low melting point are provided. Such dielectric layer may be capable of preventing the release of the gas (i.e. gas that is generated due to the residual alkyl group) into the internal space of the panel. It should be however noted that the upper dielectric layer of such dielectric layer has a higher dielectric constant, and thereby lowering an efficiency of light emission of the panel. According to the method of the present invention, in contrast, the second dielectric layer on the upper side is formed by the melting and subsequent solidifying of the silica particles, which has an advantage of being capable of decreasing the dielectric constant of the dielectric layer. Namely, the dielectric layer of the PDP obtained by the method of the present invention has a lower dielectric constant, and thus preventing the lowered efficiency of the light emission.

It is preferred that the local heat treatment is a rapid thermal heat treatment (e.g. rapid thermal annealing). In other words, the surface of the first dielectric layer is heated preferably by subjecting the first dielectric layer to the rapid thermal heat treatment such as rapid thermal annealing (RTA). This means that a high thermal response, a rapid heat irradiation and a limited heat conduction (i.e. a local heating that does not allow the heat to transfer to a deeper region) are preferable as the local heat treatment. Specifically, it is preferable to use a heat source with a high thermal response and a capability to melt the silica particles disposed in the vicinity of the surface of the first dielectric layer by rapid thermal irradiation and a limited heat conduction to prevent the heat effect from reaching a deeper region near the display electrodes. If the heat transfer reaches the deeper region near the display electrodes, a stress is generated in the first dielectric layer due to the thermal expansion of the heated display electrode, which will lead to an occurrence of the cracking phenomenon in the first dielectric layer.

According to the present invention, it is preferable to use a heat source such as a plasma torch, a laser and a flash lamp. The plasma torch, laser or flash lamp advantageously facilitates a local heat treatment so that the second dielectric layer is formed only in the vicinity of the surface of the first dielectric layer.

In a case of the plasma torch, a plasma torch annealing (PTA) process can be preferably carried out wherein only the limited shallow region of the first dielectric layer is subjected to the heat treatment. The PTA process is a process of forming a film by generating a plasma jet (high-temperature and high-speed jet) of a temperature higher than about 10000° C. with direct arc discharge between an anode and a cathode, and thereby carrying out a melting and an acceleration. As required, powder such as ceramics or cermet may be added into the plasma jet. With the PTA process, the heat (i.e. calorific value) applied to the silica particles in the vicinity of the surface of the first dielectric layer can be controlled by adjusting the conditions such as the scan speed, gap between surface of the first dielectric layer and the heat source, number of scans and output power of the heat source. By controlling of the heat (i.e. calorific value) applied to the silica particles, the thickness and arithmetic mean surface roughness Ra of the surface of the second dielectric layer can be controlled.

In the case of local heat treatment using the laser, the surface of the first dielectric layer is irradiated with laser beam. The irradiation may be performed by means of excimer laser, YAG laser, $CO_2$ laser, ultraviolet ray, infrared ray, electron beam, X ray or energy beam caused by plasma. Just as an example, a laser beam with wavelength of preferably from 600 to 1200 nm and output power of preferably from 0.5 to 100 W may be used. In a heat treatment process by the use of the laser, the heat (i.e. calorific value) applied to the silica particles in the vicinity of the surface of the first dielectric layer can be adjusted by controlling the output power of the laser or other operating conditions, and thereby the thickness and arithmetic mean surface roughness Ra of the resulting second dielectric layer can be suitably adjusted. Besides (a) controlling the output power of the laser, alternative controlling may be employed. For example, (b) controlling the scan speed of the laser, (c) controlling the beam width of the laser or (d) controlling the scan pitch of the laser may be carried out. While the above (a) to (d) may be carried out individually, they may also be carried out in various combinations.

In the case of heat treatment using the flash lamp, the heat of the local heat treatment can be applied only to the limited depth from the surface of the first dielectric layer by regulating the width of optical pulse and thus adjusting the heating period.

The thickness of the second dielectric layer, namely the limited depth to be subjected to the heat of the local heat treatment, is preferably 30% or less of the total thickness of the dielectric layer. In other words, the thickness of the second dielectric layer is in the range of preferably from 0 (excluding 0) to 30%, more preferably from 10% to 30% of the total thickness of the dielectric layer. When the thickness of the second dielectric layer is 30% or less of the total thickness of the dielectric layer, the effect of heating does not reach the deeper region where the display electrodes are disposed, even when there is variation in the heat amount (e.g. calorific value) applied to the silica particles or variation in the shape of the display electrodes during the mass production of the PDPs. In other words, when the thickness of the second dielectric layer is 30% or less of the total thickness of the dielectric layer, such a risk can be decreased as a stress is generated in the dielectric layer due to the thermal expansion of the heated display electrode so that the cracking phenomenon occurs in the dielectric layer. Since the total thickness of the dielectric layer is preferably in the range of from about 10 to 30 μm as described previously, the thickness of the second dielectric layer is preferably in the range of from about 0 (excluding 0) to 9 μm.

Figure 4:
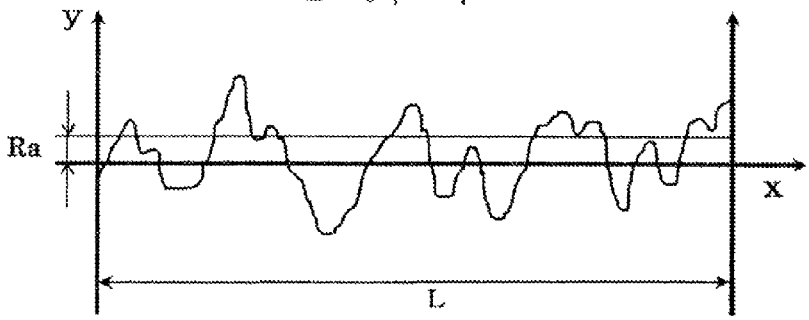
FIG. 4 is a diagram schematically showing the concept of arithmetic mean surface roughness (Ra).

Arithmetic mean surface roughness Ra of the second dielectric layer is preferably 5 nm or less (i.e. in the range of from 0 (excluding 0) to 5 nm), and more preferably in the range of from 2 to 5 nm. When the arithmetic mean surface roughness Ra is more than 5 nm, there may be some voids between the silica particles existing in the surface region of the dielectric layer, which may reduce the effect of preventing the gas from being released to the internal space of the PDP, such gas being generated due to the residual alkyl group in the dielectric layer. Inability to suppress the gas from being released can cause a deterioration of the brightness of the PDP, as described previously. The phrase "arithmetic mean surface roughness Ra" as used in this description and claims substantially means a mean value calculated from the sum of absolute values of the deviations from the average line over the length L of an evaluation section that is set in the roughness curve ("roughness curve" in this case corresponds to a section profile of the surface of the second dielectric layer). See FIG. 4.

After forming the dielectric layer, a protective layer (16) is formed as shown in FIG. 2(*e*). Namely, a film (16) made of MgO is formed on the second dielectric layer (15*b*) by a vacuum deposition process or an electron-beam evaporation process (EB evaporation process)). The protective layer (16) may be made of beryllium oxide (BeO), calcium oxide (CaO), strontium oxide (SrO) or barium oxide (BaO), not limiting to magnesium oxide (MgO). The protective layer may also be formed by a heating CVD process, plasma CVD process or sputtering process.

[PUP of the Present Invention]

The PDP obtained by the method of the present invention (namely the PDP of the present invention) will now be described. The PDP of the present invention is a plasma display panel comprising a front panel and a rear panel opposed to each other, the front panel being a panel wherein an electrode, a dielectric layer and a protective layer are formed on a substrate, and the rear panel being a panel wherein an electrode, a dielectric layer, partition walls and a phosphor layer on a substrate.

The PDP of the present invention has a two-layered structure composed of a first dielectric layer (15*a*) and a second dielectric layer (15*b*) as shown in FIG. 1(*b*) and FIG. 2(*e*), such two-layered structure being due to that a local heat treatment is additionally performed upon the formation of the dielectric layer of the front panel. More specifically, the dielectric layer of the front panel is composed of the first dielectric layer (15*a*) and second dielectric layer (15*b*) wherein the first dielectric layer (15*a*) is disposed on the substrate (10) to be in contact with the substrate (10) whereas the second dielectric layer (15*b*) is disposed on the first dielectric layer (15*a*) to serve as a surface region of the dielectric layer of the front panel. The PDP of the present invention is characterized in that the second dielectric layer is made of a material obtained by a melting of silica particles and a subsequent solidifying of the melted particles.

As described previously, there may be residual alkyl group in the dielectric layer, such alkyl group having been used for preventing the occurrence of the cracking. According to the present invention, the second dielectric layer (15*b*) corresponding to the upper layer of the dielectric layer (15) has a lower gas permeability, and thus the gas that may be contained or generated in the dielectric layer can be prevented from being released into the internal space of the panel. As a result, the PDP of the present invention can avoid such a trouble from occurring as the released gas is adsorbed onto the phosphor layer of the rear panel, which leads to a deterioration of the phosphor layer. The dielectric layer of the PDP of the present invention has a carbon concentration of from about $1.0\times10^3$ ppm to $1.0\times10^5$ ppm due to the residual alkyl group (e.g. methyl group, ethyl group, propyl group, butyl group, pentyl group and/or hexyl group, each of which has 1 to 6 carbon atoms).

In the present invention, the dielectric layer of the front panel can be formed by a so-called "sol-gel process". This means that the dielectric layer can have a lower dielectric constant. For example, the dielectric constant of the dielectric layer is preferably not higher than 5. Accordingly, a generation efficiency of ultraviolet ray is improved so that a low power consumption of the PDP is achieved. The dielectric constant as used herein means a value of the dielectric constant measured at 23° C. and 1 MHz.

Other configurations, features and producing method thereof according to the present invention have been described in "Construction of Plasma Display Panel", "General Method for Production of PDP" and "Method of the present invention", and thus description thereof will be omitted here to avoid duplication. Various conditions, specifications and effects of dielectric layer of the front panel have also been described in relation to the method of the present invention, and thus description thereof will be also omitted to avoid duplication.

The present invention has been hereinabove described with reference to preferred embodiments. It will be however understood by those skilled in the art that the present invention is not limited to such embodiments and can be modified in various ways. For example, the dielectric layer of the rear panel may also have two-layered structure, similarly to the front panel. Even in this case, advantageous effects of dielectric layer of the rear panel are the same as that of the front panel.

EXAMPLES

Examples of the present invention will now be described below. In the Examples, the second dielectric layer will be referred to as "cap layer" for the sake of convenience.

(Dielectric Material Paste)

Glass component (about 20% by weight with respect to entire dielectric material paste):

polyalkylsiloxane oligomer, spherical amorphous silica particles (particle size: about 100 nm)

Organic solvent component (about 79% by weight with respect to entire dielectric material paste):

2-ethylhexanol, ethylene glycol monobutyl ether, α-terpineol

Binder resin component (about 1% by weight with respect of entire dielectric material paste):

Polyethylene glycol (Production of Front Panel)

First, a transparent electrode made of ITO (about 120 μm in width and about 100 nm in thickness of the transparent electrode) was formed on a surface of 1.8 mm thick glass substrate (i.e. soda-lime glass manufactured by Nippon Electric Glass Co., Ltd.) and subsequently a bus electrode made of Ag (about 100 μm in width, spaced distance between electrodes being about 50 μm, a thickness of 6 to 8 μm at center of electrode and thickness of 8 to 10 μm at edge of electrode) was formed on the transparent electrode. Then the dielectric material paste (having viscosity of about 50 mPa·s at 1000 (1/s)) was applied onto the bus electrode with GAP of 100 μm by a slit coater process, dried at 80° C., and calcined in a sequence of raising the temperature at a rate of 30° C./min for about 30 minutes, keeping the temperature at 500° C. for about 20 minutes and lowering the temperature at a rate of about 2° C./min for about 5 hours, in the atmosphere. This process resulted in the dielectric layer with a thickness of about 11 μm and arithmetic mean surface roughness Ra of 12 nm.

Subsequently, as a local heat treatment, the silica particles distributed in the vicinity of the surface of the first dielectric layer were melted by means of a PTA device manufactured by Aeroplasma Co., Ltd. under conditions of gap of 5 mm between nozzle and the dielectric layer, no trimming, no $N_2$ cooling, output power of 20 kW regarding anode torch and scanning speed of 500 nm/s. As a result, a cap layer with a thickness of about 1.5 μm and arithmetic mean surface roughness Ra of 4 nm was formed.

(Released Gas Measuring Test)

Figure 5:
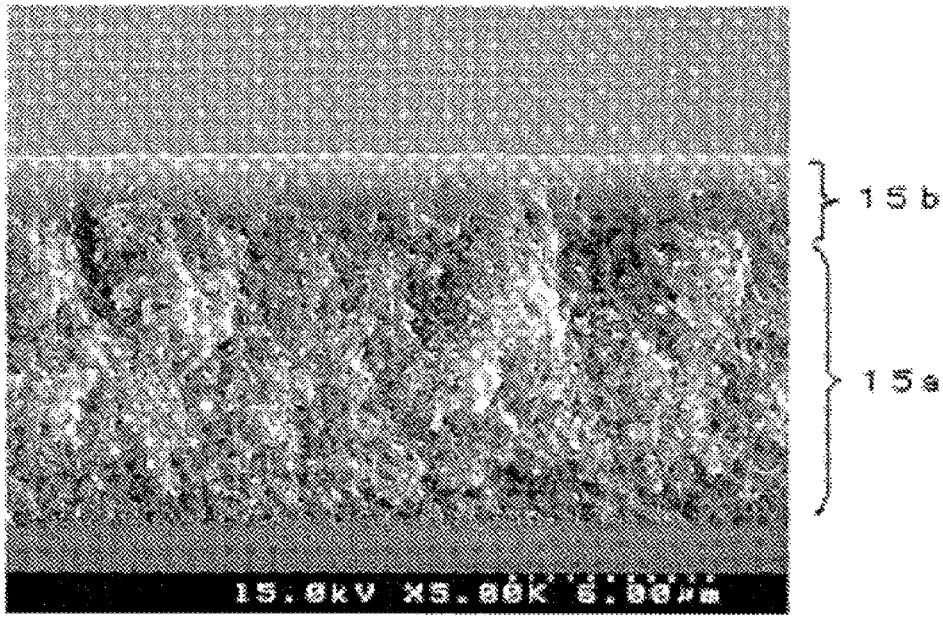
FIG. 5 is an electron microscope photograph of a section of a TDS-valuated sample.
Figure 6:
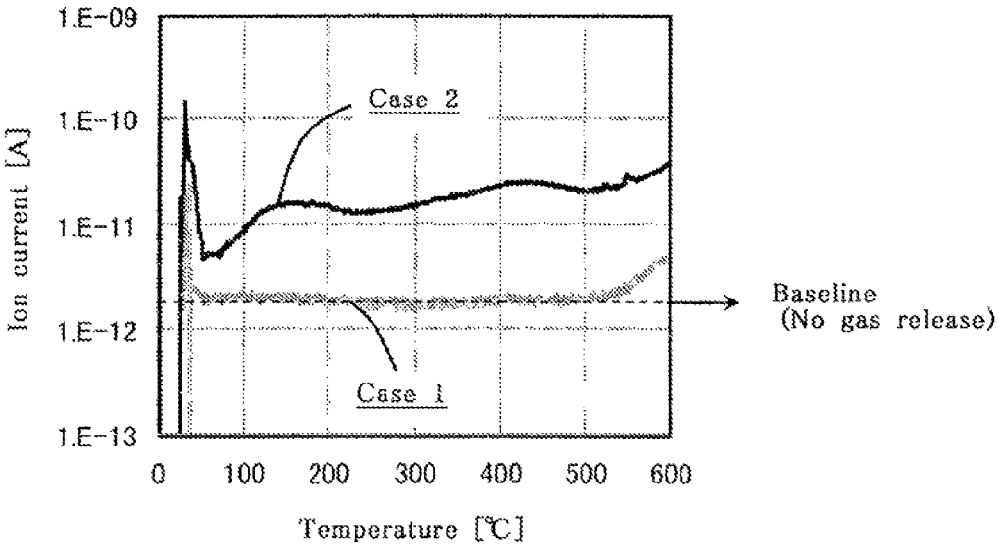
FIG. 6 is a graph showing the result of a test measuring the amount of released gas (only the data for m/z=15 is shown).
Figure 7:
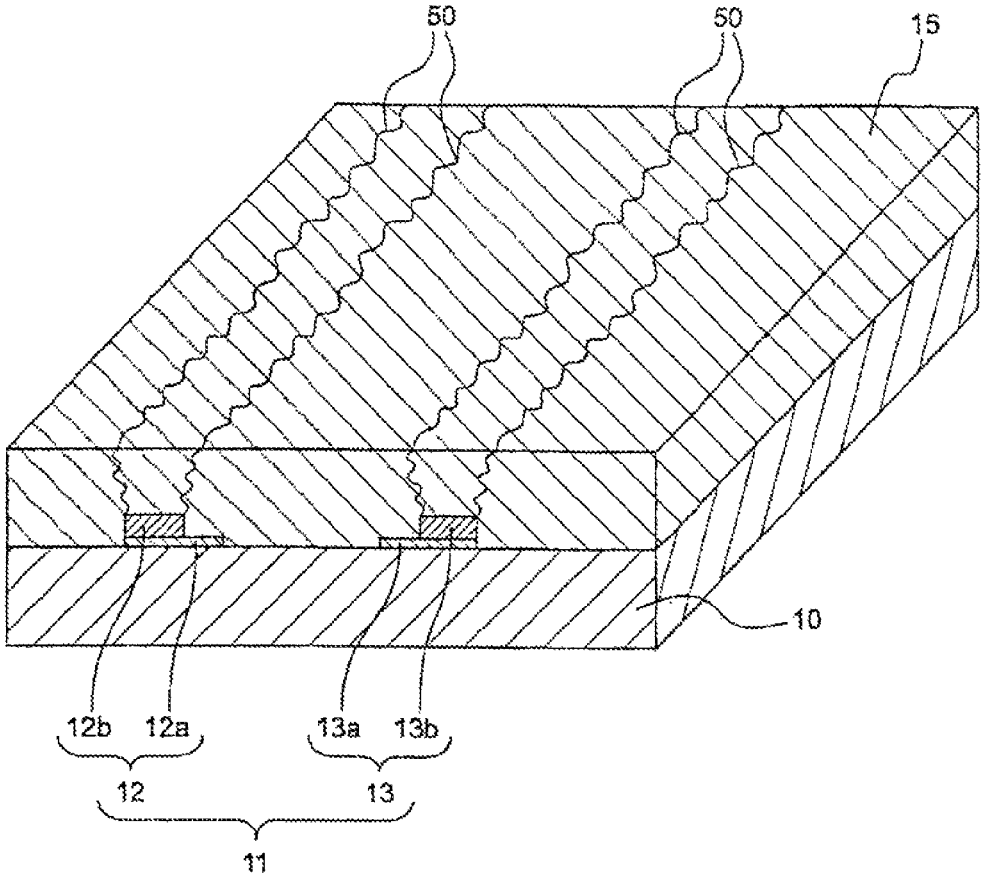
FIG. 7 is a perspective view schematically showing the cracking that has occurred in the dielectric layer.
Figure 8:
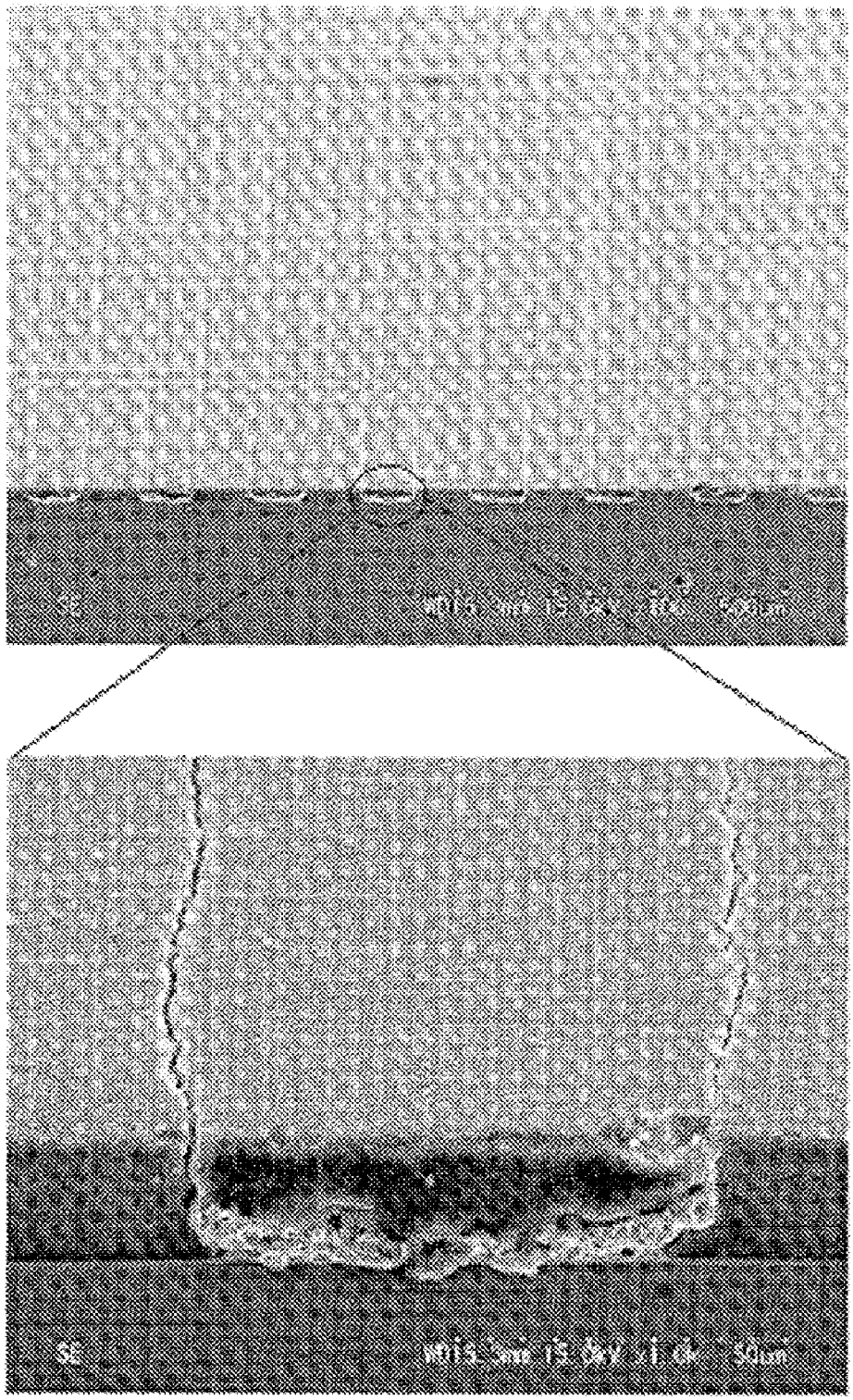
FIG. 8 is an electron microscope photograph of the cracking that has occurred in the dielectric layer.

Next, the amount of released gas was measured by using TDS (temperature increasing dissociated gas analyzer) manufactured by ULVAC-RIKO Inc. under conditions of vacuum level $2\times10^{-5}$ Pa, temperature raising rate of 5° C./min and peak temperature of 600° C. For the sample as "case 1", a piece measuring 2 cm×2 cm was cut out of the dielectric layer (see FIG. 5) formed under the same conditions on the surface of the 1.8 mm thick glass plate, because the electrode would be melted and deformed when heated to 600° C. FIG. 6 shows the mass fragmentography spectrum under condition of m/z=15. Temperature is plotted along the horizontal axis, and ion intensity is plotted along the vertical axis indicating that the released amount of the material with mass number of 15. As indicated by the result shown in FIG. 6, it was found that a formation of the cap layer causes a sharp decrease in the $CH_3$ gas characterized by m/z=15. In a temperature range of from the room temperature (about 25° C.) to 500° C., in particular, it was found that there is no released gas and that the gas permeability of the cap layer is substantially 0% (i.e. about 0 to 1%) in this temperature range. Supposedly, the possible reason for this is that the gas originating in the residual alkyl group in the calcined dielectric layer (the gas entrapped within the porous film) sill remained being confined. Moreover, another possible reason is that the burning of the residual alkyl group of the film may proceed during the melting process of the silica particles by the PTA process, and thereby the amount of the residual alkyl group in itself diminished.

Meanwhile as for the dielectric layer on which the cap layer was not formed by the PTA process, the amount of released gas was measured by using IDS (temperature increasing dissociated gas analyzer) manufactured by ULVAC-RIKO Inc. under conditions of vacuum level of $2\times10^{-5}$ Pa, temperature raising rate of 5° C./min and peak temperature of 600° C. For the sample with no cap layer as "case 2", a piece measuring 2 cm×2 cm was cut out of the dielectric layer formed under the same conditions on the surface of a 1.8 mm thick glass plate except for the formation of the cap layer. From the result of the case 2, it was found that $CH_3$ gas characterized by m/z=15 was generated in the entire temperature range of from 25° C. to 600° C., as can be seen from the graph shown in FIG. 6. This is supposedly because the gas originating in the residual alkyl group in the calcined dielectric layer (the gas entrapped within the porous film) was released from the dielectric layer surface.

(Continuous Lighting Test)

The panel provided with the cap layer (case 1) and the another panel with no cap layer (case 2) were respectively subjected to a continuous lighting test with fixed white pattern, so as to evaluate the brightness ratio (proportion of the brightness at a time after a lapse of 100 hours to the initial brightness in percentage). The results are shown in Table 1.

TABLE 1

| | | Case 1 (With cap layer) | Case 2 (With no cap layer) |
|---|---|---|---|
| Brightness ratio | Red (R) | 100% | 100% |
| | Green (G) | 99% | 84% |
| | Blue (B) | 97% | 93% |

As seen from Table 1, there is less deterioration in brightness for every color with respect to case 1 in which a smaller amount of gas is released from the dielectric layer into the panel. While on the other hand, more deterioration occurs in brightness for green (G) and other colors with respect to case 2 in which a large amount of gas is released from the dielectric layer into the panel.

INDUSTRIAL APPLICABILITY

The PDP obtained by the method of the present invention has not only a lower power consumption, but also no deterioration of brightness and thus a higher reliability which are attributable to the prevented cracking of the dielectric layer. Accordingly the PDP is not only suitable for household use and commercial use, but also suitable for use in other various kinds of display devices.

CROSS REFERENCE TO RELATED PATENT APPLICATION

The disclosure of Japanese Patent Application No. 2009-118599 filed May 15, 2009 including specification, drawings and claims is incorporated herein by reference in its entirety.

What is claimed is:

1. A plasma display panel comprising:

a front panel; and a rear panel opposed to the front panel, wherein the front panel includes an electrode, a dielectric layer and a protective layer formed on a substrate, wherein the rear panel includes an electrode, a dielectric layer, a partition wall and a phosphor layer formed on a substrate, wherein the dielectric layer of the front panel includes a first dielectric layer and a second dielectric layer, the first dielectric layer is in contact with the substrate of the front panel, and the second dielectric layer is disposed on the first dielectric layer, wherein the second dielectric layer is made of a material obtained by melting and solidifying of silica particles, and wherein gas permeability of the second dielectric layer is in the range of 0% to 1%.

2. The plasma display panel of claim 1, wherein the thickness of the second dielectric layer is 30% or less of the total thickness of the dielectric layer of the front panel.

3. The plasma display panel of claim 1, wherein the total thickness of the dielectric layer of the front panel is in the range of from 10 to 30 μm.

4. The plasma display panel of claim 1, wherein arithmetic mean surface roughness Ra of the second dielectric layer is 5 nm or less.

5. The plasma display panel of claim 1, wherein the dielectric layer of the front panel comprises an alkyl group.

6. The plasma display panel of claim 1, wherein the thickness of the second dielectric layer is 10% to 30% of the total thickness of the dielectric layer of the front panel.

7. The plasma display panel of claim 1, wherein the second dielectric layer is formed by heating the surface of the first dielectric layer to thermally metamorphose or transubstantiate the first dielectric layer to a limited depth from the surface the first dielectric layer.

8. The plasma display panel of claim 1, wherein the second dielectric layer is formed by melting silica particles in the first dielectric layer to a limited depth from the surface of the first dielectric layer.

9. The plasma display panel of claim 1, wherein a glass component contained in a dielectric material of the dielectric layer of the front panel has a siloxane bond and an alkyl group.

10. The plasma display panel of claim 1, wherein a dielectric material of the dielectric layer of the front panel has silica particles with a mean particle size in the range of from 50 to 200 nm.

11. The plasma display panel of claim 1, wherein the dielectric layer of the front panel is formed by a sol-gel process and has a dielectric constant of 5 or less.

* * * * *